United States Patent [19]

Warren

[11] Patent Number: 4,753,482

[45] Date of Patent: Jun. 28, 1988

[54] CUSTOMIZED MODULAR SEATING SYSTEM

[75] Inventor: Ronald W. Warren, Rockville, Md.

[73] Assignee: Orthotic & Prosthetic Specialties, Inc., Laurel, Md.

[21] Appl. No.: 907,150

[22] Filed: Sep. 12, 1986

[51] Int. Cl.[4] ..... A47C 7/02

[52] U.S. Cl. ..... 297/458; 5/437; 297/284; 297/459; 297/460

[58] Field of Search ..... 297/458, 459, 284, 452, 297/DIG. 4, 460, 254; 16/237, 238, 246, 235; 5/437, 446, 465

[56] References Cited

U.S. PATENT DOCUMENTS

| | | | |
|---|---|---|---|
| 1,236,517 | 8/1917 | Wemple et al. . | |
| 2,885,722 | 5/1959 | Halliday | 16/237 |
| 3,094,716 | 6/1963 | Freidman | 297/458 |
| 3,124,390 | 3/1964 | Eames et al. | 297/458 |
| 3,243,828 | 4/1966 | McCarthy | 5/437 |
| 3,376,070 | 4/1968 | Johnson | 297/459 |
| 3,765,721 | 10/1973 | Watkin | 297/460 |
| 4,234,228 | 11/1980 | Flamm | 297/284 |
| 4,403,356 | 9/1983 | Urai | 5/481 |
| 4,431,232 | 2/1984 | Hannouche | 297/460 |
| 4,471,993 | 9/1984 | Watson | 297/284 |
| 4,535,495 | 8/1985 | Oldfield | 5/423 |
| 4,572,578 | 2/1986 | Perkins | 297/460 |
| 4,592,587 | 6/1986 | Cousins et al. | 297/459 X |
| 4,597,386 | 7/1986 | Goldstein | 128/78 |
| 4,647,066 | 3/1987 | Walton | 297/DIG. 4 |

*Primary Examiner*—James T. McCall

*Attorney, Agent, or Firm*—Lowe, Price, LeBlanc, Becker & Shur

[57] ABSTRACT

A prospective user of a supportive seating system is initially measured in an approximately correct seating posture to determine which one of respective pluralities of modular preformed seat and back bases can best accommodate him. Elements of firm resilient, sculptable material are selected from precut modularly sized and shaped pluralities of the same, for assembly and attachment to the seat and back bases to create approximate support topologies. The user is seated in the support system and, based on his responses, the support topology is sculpted to custom-fit his specific needs. A temporary covering is applied to the seat and back modules. After a trail period, the quality of the custom-fit is reviewed for further sculpting as needed, and a permanent cover is then attached to each module.

17 Claims, 7 Drawing Sheets

DIAMETERS

A. 2" BELOW AXILLA
B. WIDEST PART OF HIPS
C. KNEES HELD IN LINE WITH HIPS

LENGTHS

D. SPINE OF SCAPULA TO SEAT
E. 2" BELOW AXILLA TO SEAT
F. ILLIAC CREST TO SEAT
G. SEAT TO SOLE OF FOOT
H. SACRUM TO BACK OF KNEE

CUSTOMIZED MODULAR SEATING SYSTEM

TECHNICAL FIELD

This invention relates generally to modular seating systems suitable for use in wheelchairs and, more particularly, to modular seating systems that are customized to meet the specific needs of handicapped users.

BACKGROUND OF THE INVENTION

Victims of muscular dystrophy or cerebral palsy, as well as persons who by reasons of other diseases or injury become paraplegics or quadriplegics, require supportive seating systems. In order to have the requisite ability to perform useful tasks, many such individuals utilize a variety of wheelchairs in which they frequently spend many hours at a time. Many such individuals are children when they are first afflicted, hence their seating systems have to be adapted to suit their changing needs as they grow. Older individuals who experience weight loss or gain may also require modification of the seating system.

While numerous supportive systems for wheelchairs are available, the highly specific nature of such needs often requires that the solution be highly customized, convenient for the handicapped user and reasonable both in immediate and long term costs. Over the years, two well known approaches have developed. One approach is to combine modular, preformed, adjustable elements to provide the specific support desired. The second approach utilizes individual components, molded to fit a particular patient. While both approaches provide seating systems that, in general, can be adapted to suit a variety of conventional user-propelled wheelchairs, travel chairs and the like, each approach has its own limitations and problems.

One example of the first approach is the STC II Custom System, marketed by the STC Custom Systems of Elyria, Ohio, which comprises literally hundreds of support devices, such as various sizes and shapes of pads, cushions, backs, foot plates and straps, head supports, knee abductors, shoulder harnesses, lumbar supports and custom-built seats, from which particular elements are selected and combined for mounting in a wheelchair to suit an individual. This system evidently relies on a selection from a large number of differing shapes and sizes of finished support members to "custom-fit" the user. Another system using this approach is the MED MPI seating system for children with cerebral palsy, by Medical Equipment Distributors, Inc., originally developed under the University of Tennessee Rehabilitation Engineering Program, Memphis, Tenn., which employs adjustable modular components selected after a trial fitting in an evaluation and measuring frame in which the user's measurements are taken to determine which preformed plastic components should be selected. The MED MPI system allows clinicians to experiment with various positions with a particular child to take measurements for the finalized support position, after which these measurements are forwarded to a supply source which, in turn, provides the specific components for final fitting.

One example of the second approach is the Foam In Place (FIP) seating system from Carapace, Inc., of Tulsa, Okla., also developed by the University of Tennessee, which employs a two-component polyurethane foam mixture molded to the individual patient's lower body and upper body separately to make customized seat and back components for installation in a conventional wheelchair frame. Another example of this approach is the CONTOUR U (TM) seating system by Pin Dot Products, of Chicago, Ill., in which a simulation frame holds two rubber bags filled with plastic beads - one bag for the back, one for the seat. The clinician can adjust the back-to-seat angle, and the length and angular orientation in space to find the optimum seating position. The bags can be shaped and reshaped as needed and then, using a vacuum, locked in place. Plaster bandages are then applied to the bags to give a positive, permanent copy of each mold. A layer of waterproof upholstery is vacuum formed over each mold and a liquid foam is injected to form the stuffing, so that the foam fills the complex curves exactly, forming a seat that mirrors the patient's body. Some adjustment is provided in the Pin Dot product so that the back and seat may be individually adjusted, e.g., to suit a growing child whose legs grow longer.

While the first approach has the advantage of speed in fitting the patient from numerous preformed components, it lacks the ability to provide the highly customized fitting necessary for a person who has to spend many hours, without the freedom to change his position very much. Such a system usually leads to problems with undue pressure on sensitive spots of the user's body, bed sores and the like. While this system may be cost efficient, it is not necessarily suitable for most users for prolonged use. The second approach inherently provides for highly customized shaping of the supportive elements of the seating system, but the actual fitting tends to be time consuming, expensive and not amenable to significant adjustment after initial formation.

A need exists, therefore, for a customized seating system, suitable for use with conventional wheelchairs and the like, that combines the cost-effectiveness of modular components with highly individualized personal fitting of the final product to a particular user's needs.

DISCLOSURE OF THE INVENTION

Accordingly, it is an object of this invention to provide a modular, customized seating system that provides both a seat and a back element individually fitted to a particular user.

It is another object of this invention to provide a modular, customized seating system with seat and back elements individually fitted to a particular user and providing lateral support to the outsides of the thighs and thorax.

It is a further object of this invention to provide a modular, customized seating system with seat and back elements individually fitted to a patient and capable of highly adjustable fitting within the framework of a conventional wheelchair, travel chair and the like.

It is an even further object of this invention to provide a modular, customized seating system including a seat and a back element individually fitted to a particular user, suitable for use with a conventional wheelchair, travel chair and the like, and usable in combination with a conventional headrest, footrest and chest and chin restraints.

It is a related object of this invention to provide a method for custom-fitting pre-selected modular seat and back elements which combine to provide supportive seating for a handicapped user.

It is another related object of this invention to provide a method for iteratively customizing modular seat and back components of a supportive seating system, to facilitate the adoption of the seating system by a user adjusting to prolonged use thereof.

These and other objects of this invention are realized by providing a modular body support system including a seat module and a back module each custom-fitted to a particular user. The seat module has a seat base and a layer of readily sculptable material thereon, the seat base and sculptable material being sized and shaped initially on the basis of the user's body measurements in the seat region that is to be supported. The topology of the seat sculptable material is then custom-fitted to the user's body by the removal of sculptable material to relieve local pressure and the addition of sculptable material to enhance local support, as needed, in iterative response to the user's reaction when seated thereon. The back module similarly has a back base and a layer of sculptable material thereon, these being initially sized and shaped on the basis of the user's body measurements in the back region. The topology of the back sculptable material is then custom-fitted to the user's body, by iterative removal and addition of sculptable material, as needed, in response to the user's reaction when in a seated posture to be supported by the back module. In one aspect of this invention, the seat and back modules are covered, pivotally attached to each other, and adjustably supported in a conventional travel chair frame.

Still other objects and advantages of the present invention will become readily apparent to those skilled in this are from the following detailed description, wherein only the preferred embodiments of the invention are shown and described, simply by way of illustration of the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE PREFERRED EMBODIMENTS

The persons most likely to benefit from the present invention are individuals who suffer multiple handicaps and require proper seating to function comfortably to the best of their abilities. They include victims of diseases such as muscular dystrophy and cerebral palsy as well as paraplegics who have the upper body strength and facility to propel themselves in conventional wheelchairs by using their arms. The seating system of this invention is adaptable for use with conventional wheelchairs, travel chairs in which the occupant is pushed by another person, and the like.

Figure 2:
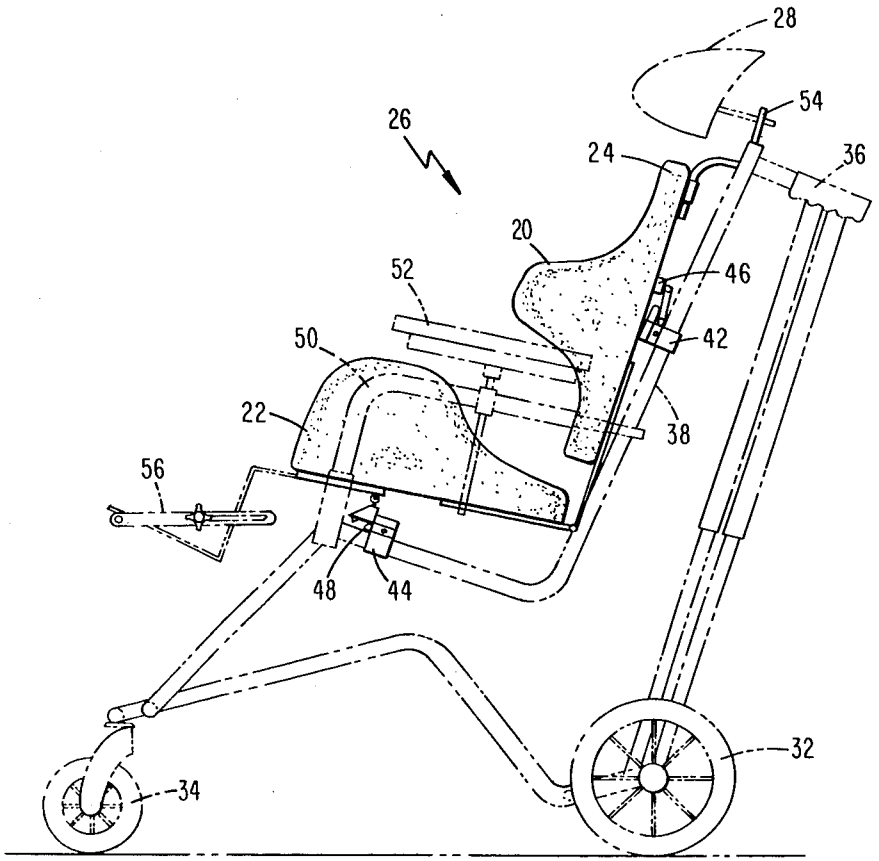
FIG. 2 is a side elevation view of this invention supported within a conventional travel chair (shown in phantom lines).
Figure 1:
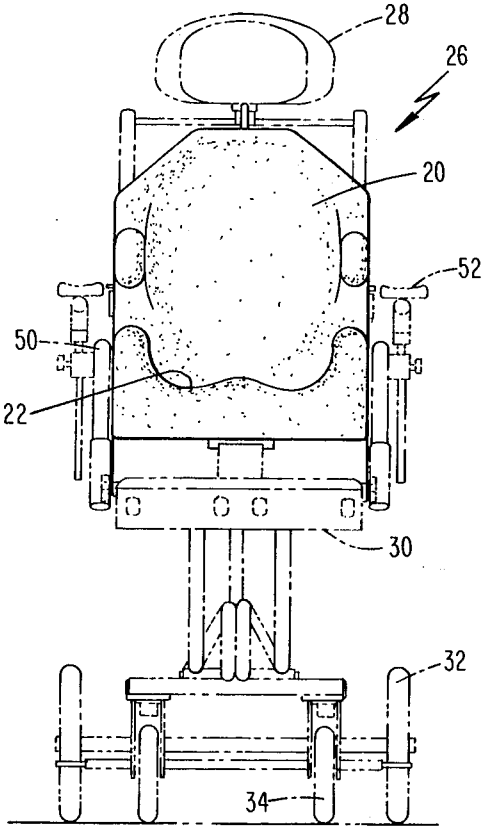
FIG. 1 is a front elevation view of a conventional travel chair (shown in phantom lines) incorporating the seating system according to a preferred embodiment of this invention.

Referring now to FIGS. 1 and 2, the preferred embodiment of the seating system of this invention is shown mounted within the framework of a conventional travel chair, i.e., the type in which the handicapped individual may be seated for long periods but which he himself would not propel. With obvious adjustments and minor differences, readily understood by persons who work with such handicapped individuals, the seating system of this invention can be comparably mounted to other types of wheelchairs.

The typical travel chair 26 has a tubular frame (shown in phantom lines) supported by rear wheels 32 and front caster wheels 34. The person pushing it would grasp it at the rear at handgrips 36. The chair frame includes seating system support members on each side, comprised of substantially vertical portions 38 and substantially horizontal portions 40. These tubular portions 38 and 40 join in a generally "L" shape. Somewhat smaller but similarly "L" shaped segments 50 are attached to portions 38 and 40 to provide support for armrests 52 on each side.

Seat element 22 usually is mounted slightly above portions 40 of the frame, and back 20 is mounted somewhat forward of the upper portions 38. Although the seat and back modules, 22 and 24 respectively, can be separately mounted to the frame of the supporting wheelchair, considerations of strength and convenience lead to pivotal attachment of the seat to the back.

Figure 3:
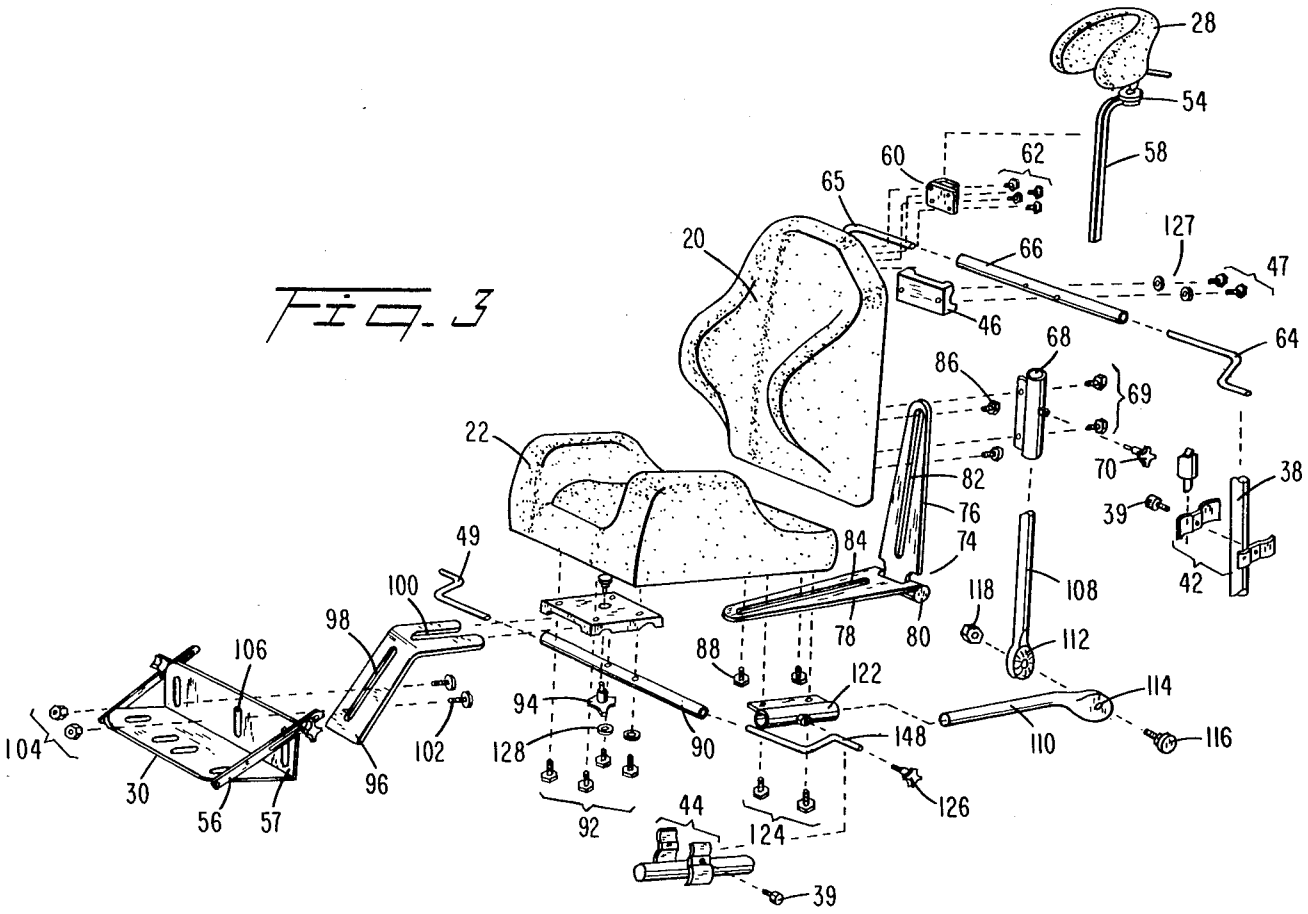
FIG. 3 is an exploded perspective view of a preferred embodiment of this invention, together with a conventional headrest and footrest.
Figure 10:
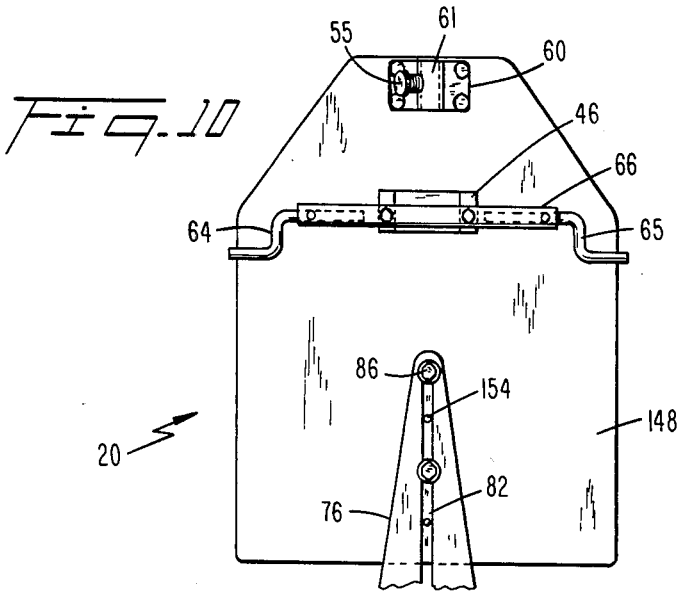
FIG. 10 is a rear elevation view of the back element of the seating system.
Figure 11:
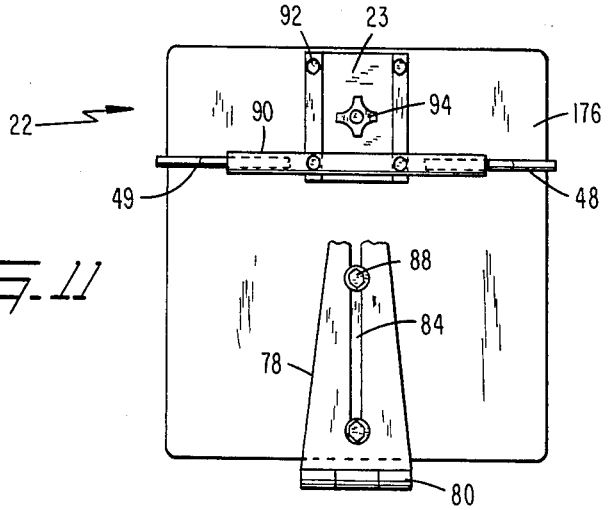
FIG. 11 is a plan view of the lower face of the seat element.

Referring to FIG. 3, a hinge 74 having a hinge axis 80 and two pivotal arms 76 and 78, provided with slots 82 and 84 respectively therein, enables convenient and adjustable attachment of seat module 22 to back module 20 by means of bolts 86 and 88. Reference at this point to FIGS. 10 and 11 will clarify that the hinged arms 76 and 78, attached respectively to the back and the seat, are disposed about the axis of symmetry of each and are preferably attached with at least two bolts, 86 or 88 as applicable. By slightly loosening the attachment bolts 86 or 88, one or both of back module 20 and seat module 22 can be positioned at varying distances from hinge axis 80.

Back module 20 is provided at its rear surface with a mounting bracket 46 to which is bolted on a tubular element 66 by bolts 47. Two outriggers, 64 and 65, each formed of metal rod to have parallel legs separated by a transverse leg, are fitted into the open ends of tubular element 66. The generally upright portions 38 of the wheelchair frame are ach provided with extrusion brackets 42 comprised of a pair of elements that clamp onto portion 38 by tightening of bolt 39. When extrusion brackets 42 are so clamped on, one on each side of the frame, each provides a generally cylindrical open space between their extensions 43 to receive an attachment fitting 72 attached to back module 20.

Figure 14A:
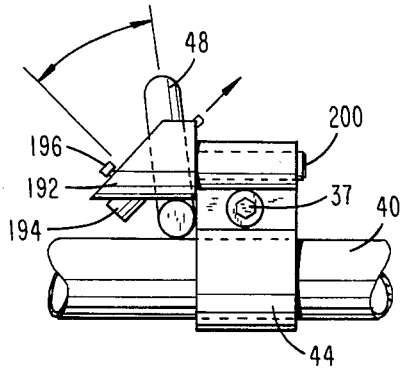
FIGS. 14A and 14B are enlarged side elevation views of the mounting elements of FIG. 13.
Figure 14B:
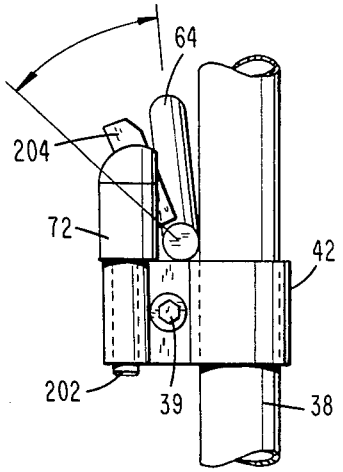

As best seen in FIG. 14B, the horizontal depending leg of outrigger 64 rests on the upper edge of extrusion bracket 42 and a pop-in pin 202 of engagement fitting 72 is received in the front cylindrical portion 43. Tightening of bolt 39 insures that extrusion bracket 42 firmly attaches to vertical portion 38 of the wheelchair at one end and about the pop-in pin 202 at the other end. Attachment fitting 72 is provided with a slot that carries a conventional pivoted and preferably spring-biased locking element (details omitted from FIG. 14B for simplicity) having an end 204 accessible by a user and an end 206 that rests against a portion of outrigger 64 to retain it at the extrusion bracket. The application of a rightwardly directed force at end 204 would cause end 206 of the retaining member to rotate away from outrigger 64 and allow the latter to be removed vertically upward from its resting point above extrusion bracket member 42. Intromission of outrigger 64 into the space between retaining element 72 and vertical portion 38 of the wheelchair is effected simply by dropping in the outrigger 64 to cause end 206 at the locking element to rotate away and to return under the bias of the spring.

Figure 12:
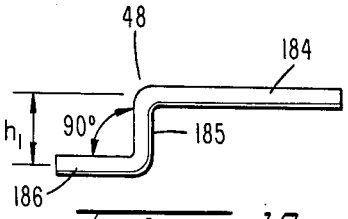
FIGS. 12A and 12B are side elevation views of two alternative outriggers of the type employed to adjustably support the seat and back elements of the seating system in a wheelchair frame.

It should be noted that a typical outrigger may have the alternative configuration 187 of FIG. 12B, in which parallel arms 190 and 188 are separated by a transverse arm 189 that forms an angle less than 90 degrees with each of the two parallel arms. The selection of configuration 48 or 187 for the outriggers is dependent on the width of the seat compared to the width of the wheelchair. As persons skilled in the art will appreciate, configuration 187 for the outrigger will permit a somewhat wider seat to be fitted into a given wheelchair frame than configuration 48.

Referring now to FIGS. 3 and 11, it is seen that the lower surface of seat module 22 is provided with an attachment bracket 23 to which is mounted a tubular element 90 similar to tubular element 66 of back module 20. Outriggers 48 and 49 are inserted into the free ends of tubular element 90 and provide depending ends to receive support forces from horizontal portions 40 of the wheelchair frame. FIG. 14A makes it clear how extrusion bracket 44, affixed by bolt 37 to horizontal portion 40 of the wheelchair frame clamps onto the pin 200 of a retainer fitting 192. Unlike fitting 72, fitting 192 employs a conventional spring-biased sliding locking element 194 (details omitted from FIG. 14A for simplicity). The design of fitting 192 requires a user to push on extension 196 of sliding member 194 to cause it to slide away from horizontal portion 40 to enable the intromission or removal of outrigger 48. Thus while it is relatively easy for a user to deliberately release seat module 22 from the wheelchair frame, such a fitting 192 prevents casual or accidental disconnection.

It is quite common for a person utilizing such a seating system to require some support for his head and for his feet. As indicated in FIG. 3, a conventional headrest 28 mounted to a universally adjustable fitting 54 is supported by a vertical tubular member 58. Back module 20, FIG. 10, is provided with a bracket 60 having an open tubular portion 61 to receive tubular member 58 of the headrest therewithin. A hand-tightened screw element 55 is provided to clamp tubular member 58 so that headrest 28 is at a predetermined height to suit the convenience of the user. Universal fitting 54 is of conventional kind and may be tightened to retain the headrest 28 at the most comfortable angle. It is seen thus that the present invention provides a seat and back combination that can be used with conventional elements such as headrest 28.

Mounting block 23 attached to the front of the rear surface of seat module 22, FIG. 11, is designed to receive a horizontal portion of a footrest mounting bracket 96, at an open-ended groove 100 therein, such that hand-tightening of bolt 94 causes bracket 96 to become attached to the front of seat module 22. A foot rest 30, comprised of two hinged members and slotted adjustable side elements 57, is attachable at an elongate aperture 106 to a front slot 98 of bracket 96 by bolts 102 and nuts 104.

The seat and back combination according to this invention is easily mounted in a conventional travel chair 26, and with obvious modifications to a conventional wheelchair. Conventional headrest element 28 and a conventional footrest element 30 can be easily added as described. This is an extremely valuable feature of the present invention, in that it permits better retro-fitting of existing wheelchairs and travel chairs to provide to their users the advantages of the present invention. The present invention is not limited in use only to wheelchairs especially designed to receive the same but is capable of its fullest use in virtually any conventional wheelchair, travel chair or the like.

It should be noted that the vertical portions 38 and horizontal portions 40 at either side of the wheelchair need not each be extensions of a single element, but may be comprised of two pivotally joined elements 108 and 110. In such an alternative, the upright portion 108 and the horizontal portion 110 are pivotally connected to each other by a bolt 116 and a nut 118. In such a configuration, seat module 22 may be attached directly to elements 110 and the back module 20 elements 108, respectively, and the hinge between the seat and back modules may then be omitted. It may also be desirable to provide a roughened or ridged surface 112 to at least one of each pair of the coacting portions 108 ad 110 to fix them with respect to each other to form lockable hinges. This type of structure is useful in a wheelchair which provides the facility for the patient to be supported in a reclining position. In other words, by tightening bolt 116 and nut 118, portions 108 and 110 of the wheelchair frame become affixed but upon their release the wheelchair and the seat and back system attached thereto may be caused to attain a different configuration, e.g., one that allows the patient to recline on his back. Persons skilled in the art will immediately appreciate that the seat and back modules 22 and 20 of this invention, if they are mounted to be pivotally attached at hinge axis 80, will cooperate with such a changed configuration of the frame as yet another alternative configuration to fully support the patient in a variety of positions.

Figure 13:
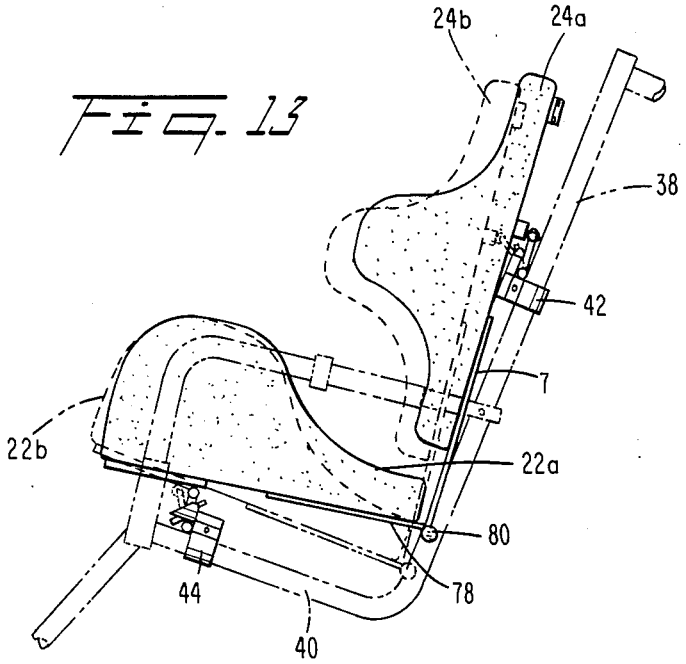
FIG. 13 is a side elevation view indicating alternative positions of the seating system while mounted in a wheelchair.

As seen with reference to FIG. 13, even with a fixed support configuration provided by portions 38 and 40 of the wheelchair frame, rotation of outriggers 64, 48, and their companions on the opposite side, the seat and back module assembly can be adjusted as indicated by broken lines. Thus, the topmost portion 24 of back module 20 can be placed in a first position 24*a* with outriggers 64 and 65 rotated backward and a second position 24*b* when these outriggers are rotated forward. Outriggers 64 and 65 can be affixed at selected positions within tubular element 66 by lock-screws 63. Likewise, and entirely independently, seat module 22 can also be adjusted by the rotation of outrigger 48 from a first position 22*a* to a second position 22*b*. Outriggers 48 and 49 can be affixed at selected positions within tubular element 90 by lock-screws 47. It is thus clear that the present invention is usable with conventional wheelchairs and is highly adjustable in use therewith. The manner of attaching and adjusting the apparatus of the present invention having been explained, a detailed description will now be provided of the manner of selecting and customizing the individual modular elements to meet the specific needs of the individual user.

Figures 5, 6:
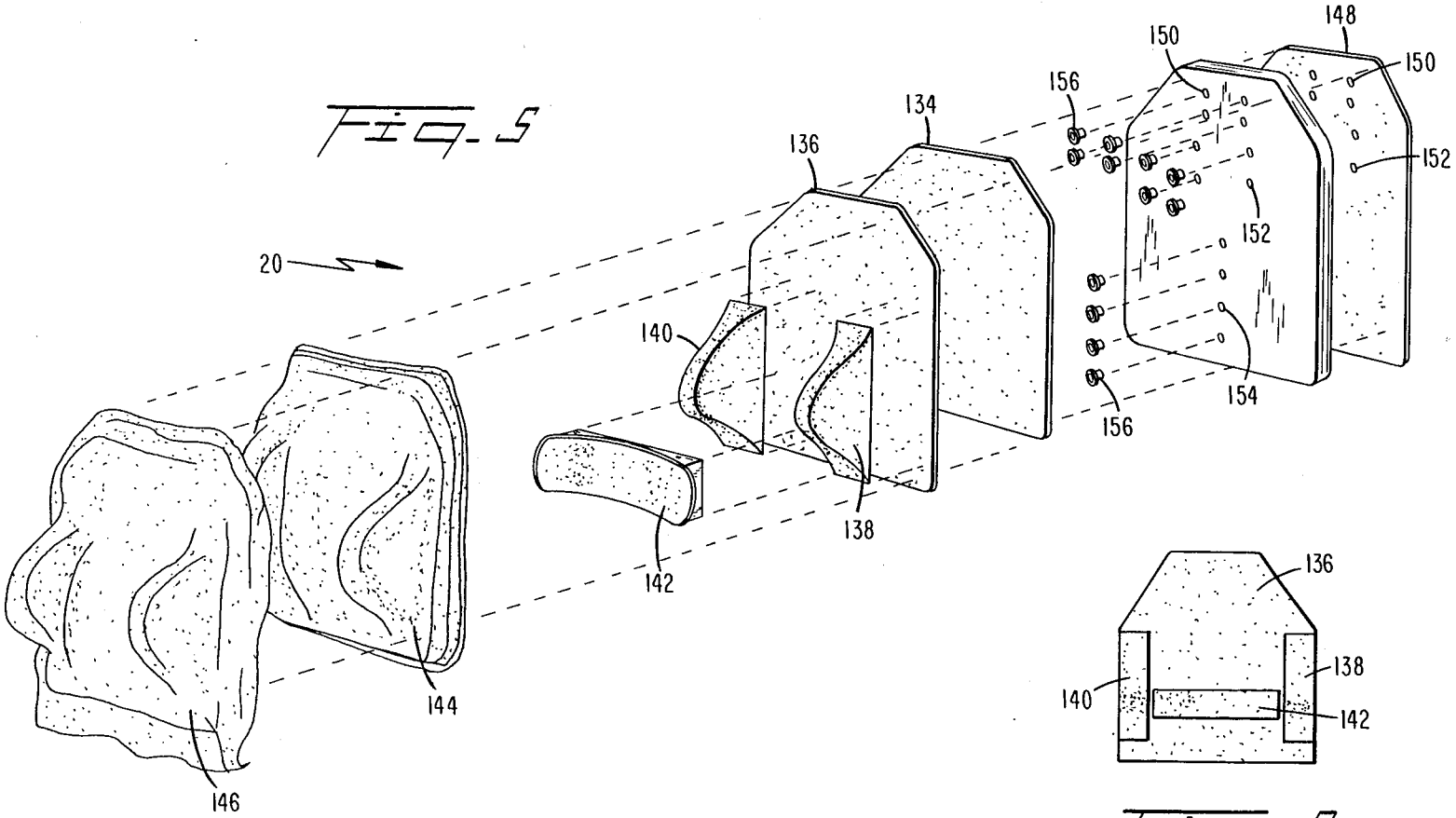
FIG. 5 is an exploded perspective view of the back element of the seating system of FIG. 3.
FIG. 6 is a front elevation of the back element of the seating system of this invention prior to contouring thereof to fit the user.

Back module 20 and seat module 22 have generally similar structures. Referring to FIG. 5, back element 20 includes a substantially rectangular hardwood plywood base 132 with its upper corners reduced. Base 132 is provided with a series of vertical apertures 154 to receive bolts 86 for the attachment of vertical arm 76 of hinge 74. Directly above apertures 154 is provided a rectangular array of apertures 152 to allow the affixation of bracket 46 at a choice of two vertical positions. Finally, above apertures 152 is provided a rectangular array of apertures 150 for the attachment of bracket 60. Development work on this invention had indicated that high quality hardwood plywood, preferably one-half inch thick, is most suitable for the intended use. Conventional T-nuts 156 are inserted into each of the apertures 150, 152 and 154. Each T-nut has an internally threaded portion to receive the appropriate bolts. Back module 20 is assembled by attaching to base 132, at the same side as the heads of T-nuts 156, one or more layers of a firm but resilient plastic foam material 134 and 136. Although only two such layers are shown in FIG. 5, it should be understood that any number more than one may be utilized as needed. The most suitable material for these layers is found to be a flame retardant foam marketed as "Ethafoam", a Dupont product. The most convenient way for attaching the Ethafoam to the plywood is to spray each with a contact adhesive of conventional type and to press the mating surfaces together briefly thereafter.

Most users of this invention are likely to require some thoracic support. Thoracic supports 138 and 140, made of precut Ethafoam, are adhered by contact cement to either side of the exposed surface of the foam attached to base 132. For those patients who may require some lower back support, a precut Ethafoam lumbar support element 142, with a generally concave cylindrical front and a flat base, is similarly adhered between the thoracic support elements 138 and 140 to the exposed surface of foam layer 136. FIG. 6 shows a front elevation view of the assembly of back module 20 at this point.

As described more fully hereinbelow, careful sculpting of the Ethafoam is carried out, with the user providing the necessary informational feedback to the clinician, to customize the Ethafoam topology to provide the most advantageous support for the user. At this stage of this assembly, back module 20 is laid horizontally upon a conventional vacuum table and a thin heated sheet 144 of a somewhat softer foam plastic material, preferably one-quarter inch thick "Volara" (TM) foam, sprayed with an adhesive, is placed on the sculpted Ethafoam. The vacuum applied to the plywood base is conveyed through the apertures 150, 152 and 154 to the Ethafoam to suck the thin quarter inch Volara foam layer into a good adhering contact with the Ethafoam surface. A thin sheet 146 of vinyl-coated fabric or other similar coating material is sprayed with an adhesive and affixed to the Volara foam, with the application of heat, to provide a user contactable covering. This vinyl coating is extended to the back of the plywood sheet 132 and at this first stage, is simply stapled thereto.

Figure 7:
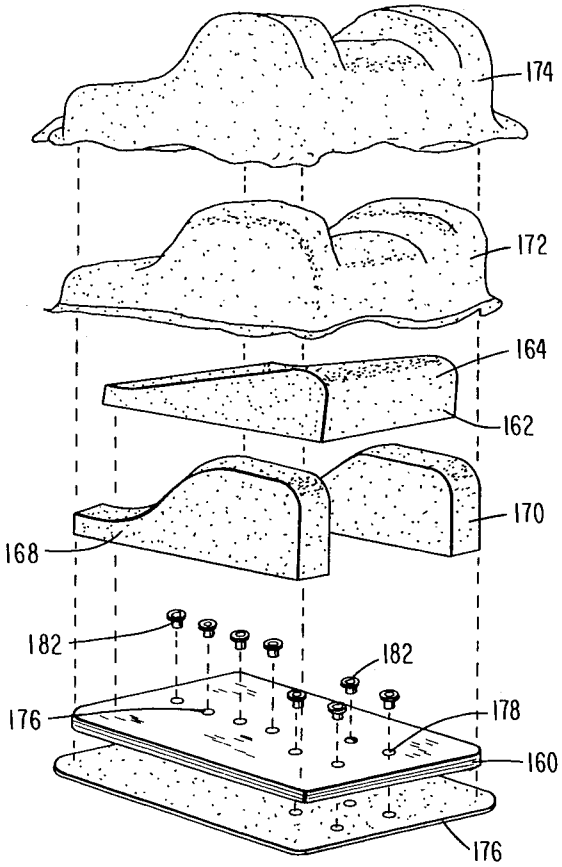
FIG. 7 is a perspective exploded view of the seat portion of the seating system of FIG. 3.

A generally similar procedure is followed in preparing seat module 22. The seat module 22, FIG. 7, has a hardwood plywood base 160, of a generally rectangular shape, to which is adhered a generally wedged shaped Ethafoam piece 162 that has a smoothly curved upper forward edge 164 and a rearward slope to an end 166. The slope of the upper surface of foam element 162 with respect to its flat base is preferably 15 degrees, although other inclinations may be found more suitable for particular patients. Precut Ethafoam lateral leg bolsters 168 and 170 are then adhered to the base 160 and the outside surfaces of wedge foam element 162. As more fully discussed herein below, the user is seated on the Ethafoam at this stage, and with informational feedback from him, the clinician sculpts the Ethafoam, removing or cementing small portions to it as necessary, to customize the support topology provided by the foam to the user.

Figure 8:
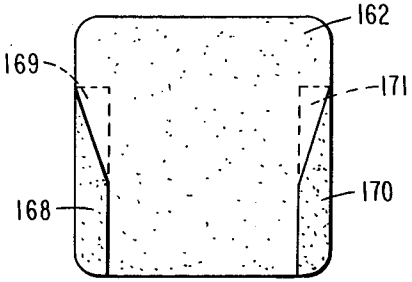
FIG. 8 is a plan view of the seat element of FIG. 7 at an intermediate stage in the process of contouring to fit the user.

As indicated in FIG. 8, it may be necessary to remove portions of lateral leg bolsters 168 and 170, i.e., portions indicated by broken lines as 169 and 171 in FIG. 8, to generate sufficient room for the user's thighs.

Depending upon the user's anticipated needs, a pommel (not shown for simplicity) can be shaped out of Ethafoam and attached centrally of the seat near the front of wedge roll 162 to separate the user's legs. Naturally, the pommel must also be shaped and sculpted to fully respond to the user's feedback.

At this stage, the seat assembly is placed on a conventional vacuum table and a preheated thin layer of Volara foam 172 is adhered thereon. This provides a smooth contiguous surface to which is then adhered a vinyl or other coating 174 similar to coating 146. The edges of the coating 174 at this stage are stapled to the bottom surface of plywood base 160.

Note that plywood base 160 is provided with a series of apertures 180 to receive bolts passing through slot 84 of arm 78 of the hinge connecting the seat and back modules. This is best seen with reference to FIG. 11. An array of four apertures 178 is provided to enable the attachment of bracket 23, also best seen in FIG. 11. Conventional T-nuts 182 are affixed in apertures 178 and 180 to provide threaded portions to receive the respective bolts. Ethafoam layer 162 covers the heads of T-bolts 182 in the final assembly.

Figure 9:
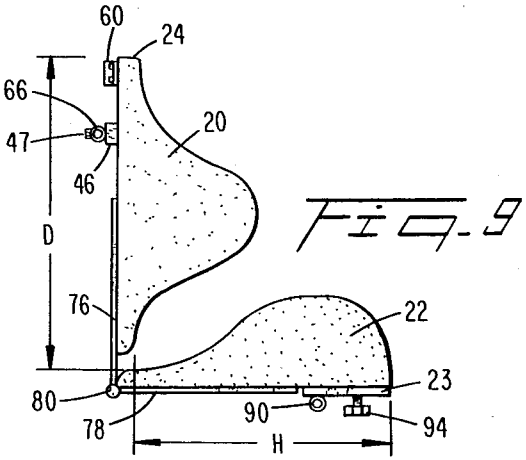
FIG. 9 is a side elevation view of the seat and back combination of the seating system.

When back module 20 and seat module 22 are bolted onto hinge 74, as best seen in FIG. 9, adjustment of each module with respect to the slot on its respective arm of hinge 74 facilitates adjustment of distance D from the rear seat surface to the top 24 of back module 20 and the distance H from the front surface of the back module 20 to the front edge of seat module 22.

The preceding paragraphs have described the general structure of the back and seat modules according to this invention and their use with each other in conventional wheelchairs, specifically a travel chair. A more detailed description of the manner of customizing the topology of modular seat and back modules will now be provided.

Plywood elements 132 and 160, for the back and seat modules respectively, are pre-cut to standardised sizes, e.g., 8 inches by 12 inches, 10 inches by 12 inches, 12 inches by 14 inches, and the like. For manufacturing and inventory purposes these may be assigned specific code numbers as for any manufactured parts. The upper corners of the back element 132 are cut at approximately 45 degree angles so that the upper edge that is left is approximately one third of the parallel bottom edge. All corners are rounded off for safety. Also, plywood pieces 132 and 168, of whatever size, are drilled and provided with the necessary T-nuts to receive bolted-on components. Thin foam pieces 134 and 136 for the back module 20 are, likewise, precut to match in shape plywood element 132. Thoracic support elements 138 and 140, leg support elements 168 and 170, wedge roll elements 162 and lumbar support elements 142 are, likewise, precut from Ethafoam to suit the various sized back and seat plywood elements 132 and 160. Leg support elements 160 and 170 typically are approximately two inch thick and have parallel sides. Wedge roll element 162 typically has a three inch maximum height at the front and approximately one inch height at the rear end, although other forms with a greater inclination of the top surface with respect to the bottom may be required for certain users. Thoracic support elements 138 and 140 have a generally parabolically profiled side, flat exterior surfaces and gently curved interior surfaces, substantially as shown in FIG. 5. These various foam pieces are also assigned inventory part numbers for ease of reference.

Figure 12A:
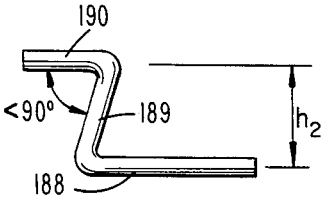

Naturally, hinges 74, tubular members 66 and 90, and outriggers 48 or 187 are also manufactured to suit the range of back and seat elements discussed above, e.g., outriggers angled at less than 90 degrees and with a larger height "$h_2$" instead of "$h_1$" for large-bodied users (FIGS. 12A and 12B).

In summary, all the essential elements that are assembled to form the back and seat module and support attachments are modular in form and typically are available for quick assembly as desired. The key to the success of this invention is in the rapid selection of the right modular parts, their assemblage together, and quick and easy customization of the final shapes of the seat and back modules to precisely meet the needs of individual users.

Figure 4:
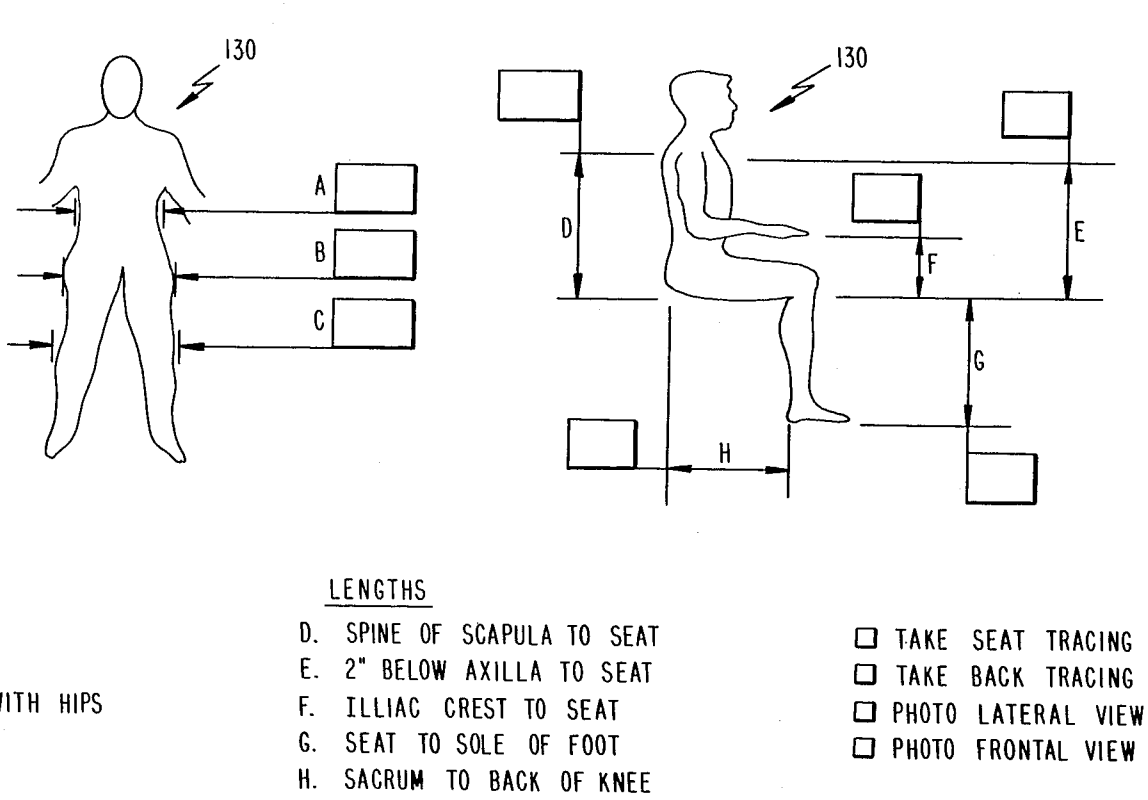
FIG. 4 is a schematic diagram (suitable as a check list) indicating the various patient measurements that are made in the course of custom fitting a patient according to this invention.

Not all patients or prospective users of the seating system of this invention have the strength or the ability to remain seated while measurements are made. For such patients essential measurements may be made while the user is lying supine. For those potential users who can sit for limited periods, perhaps with some assistance, it is preferred that the measurements be made with the user in an uprighted seated position. Reference should be had at this stage to FIG. 4 for an understanding of the various measurements that must be made. Although a conventional seating simulator may be convenient to use, one is not essential to make the necessary measurements and the prospective user may be seated in a chair. The sequence of steps is as follows:

Step 1 Determine the width of the patient's back at a point approximately two inches below the axilla, width A. For most users, a back plywood element 132 not less than two inches wider than width A may be needed.

Step 2 Measure the user at the widest part of the hips, width B.

Step 3 Measure the distance between the outside of the knees held in line with the hips, Width C. Depending on the user's particular condition and needs, a plywood seat base element 160 at least two inches wider than the larger of width B or C as indicated.

Step 4 Measure the vertical distance from the spine of the scapula to the seat, length D. The upper edge of the finished back module 20 should be located at a distance D above the finished seat.

Step 5 Measure the distance from the seat to a point two inches below the axilla, length E. The top of the thoracic support elements, for most patients, Step 6 Measure the distance from the iliac crest to the seat, length F. The top of the armrest of the wheelchair most likely will be adjusted to be at a height F above the seat.

Step 7 Measure the vertical distance from the seat to the sole of the foot. This is the approximate distance between the seat and the footrest.

Step 8 Measure the horizontal distance from the sacrum to the back of the knee, length H. The seat module 22 can be adjusted horizontally with respect to back module 20 by its location within slot 84 of arm 78 of the hinge connecting the two.

It is also helpful to an experienced clinician to have a tracing of the seat, a tracing of the back, and photographs showing the frontal and lateral views of the patient in seated position. These tracings and photographs are of assistance to a clinician who has only limited time with the prospective user of the modular seating system being customized.

Measurements A-H are utilized in the pre-fitting stage to make some early decisions on how much to trim or modify the precut foam elements. Thus thoracic support elements 138 and 140 may be trimmed along the inner sides to add more room or they may be moved in to take up some room. In the same manner, leg support bolsters 168 and 170, as indicated in FIG. 8, may be trimmed at the inside to provide more room for the patient's legs. If more than one inch has to be cut away from the inner surfaces of leg support bolsters 168 and 170, it is an indication that the next larger size of wedge roll 162 should be used instead.

Various other considerations must be given due weight in the customization process. Thus, for example, for users who will incorporate this seating system in a conventional wheelchair which they will propel themselves, it is important that they be able to reach the propulsion rims of the wheels comfortably. This will generally require that for good balance in motion the seat be positioned as far back as possible with respect to the vertical seating system supporting portions 38 of the wheelchair frame. This can be dome by adjusting the position of seat module 22 on arm 78 of slotted hinge 74. Also, for such a user the seat generally must be as low as possible, and what is known in the art as a "drop seat" may be necessary. In this case, the distance between the wheelchair's seat rails 38 must be measured and binding portions of the plywood seat element 160 may have to be ground away to allow the seat to be located lower within the wheelchair frame.

Sequentially, therefore, the clinician selects the various components in accordance with the user's measurements, makes initial cuts in the individual foam components and the seat plywood element as indicated above, and then assembles the foam components to the respective plywood bases of the back and the seat modules. Experience has shown that it is most convenient to use commonly available commercial spray contact cement on both the plywood surface and the Ethafoam surface and to put them in firm contact with each other after an initial recommended drying period. Thus, for example, having selected the appropriate wedge roll 162, the clinician will spray the top surface of plywood base element 160 and the under surface of wedge roll 162, wait briefly if necessary for the initial drying of the cement, and then carefully place the Ethafoam on the plywood and apply a firm pressure, thereby obtaining a secure, firm and generally water resistant bond therebetween. Leg support elements 168 and 170 likewise are sprayed at the contacting surfaces, as is the exposed portion of plywood base element 160 to either side of wedge roll 162 and respective elements adhered as appropriate.

The various extrusion brackets and attachment elements such as tubular elements 66 and 90, as well as attachment elements for the headrest and footrest if such are to be used, are assembled with the seat and back modules 22 and 20 respectively attached to hinge 74. This pre-fitting assembly is then mounted by means of the pop-in pins at the outriggers, adjusted in position as appropriate, in preparation for customized fitting of the user.

The user is placed in the seating system and the conventional safety belt of the wheelchair snugly fastened across him with the user sitting all the way back in the seat. It may be necessary to flex the user somewhat at the hips to get him to sit back far enough. At this point there should be at least a half inch gap between the front end of the seat and the back of the user's legs. If this is not the case, the seat module 22 should be moved on hinge 74 as necessary.

Leg support bolsters 168 and 170 should not press too tightly on the lateral side of the user's legs. In fact, it is preferred that there should be at least a half inch clearance between the seat bolster inner surfaces and the patient's legs.

The user should not have a great amount of extensor tone with the standard degree of wedge roll, i.e., 15 degrees, incorporated into the seat module 22. If there is a large extensor tone, then a high inclination may be necessary. This may be checked by the clinician lifting the user's legs and noting whether there is any significant change in the extensor tone. If there is, then the seat may need to be flexed at a greater angle, which can be accomplished by rotating the outriggers 48 and 49 so that the front of the seat rises and the back remains vertical with respect to the floor. Recall that these outriggers can all be individually affixed in their respective mounting tubular members by lock-screws 47 and 63.

The preceding discussion relates mainly to the removal of foam where necessary to provide a desired clearance between the user's body and the support surfaces. In practice, this is most readily accomplished by the use of a small, drill-mounted, rotating grinding cone of conventional type. This cone may also be utilized to round-off and blend-in adjacent surfaces as desired. The clinician must be guided by feedback provided by the user who is the person most aware of where he experiences discomfort as a result of undue localized pressure. Local relief by grinding away of the foam at the appropriate points, in small amounts, will quickly generate the desired relief. Such relief traditionally is needed in the sacral area or at the ischial tuberosities.

If the user's condition makes it desirable, a pommel can be shaped out of Ethafoam and placed to separate his legs, with particular care taken to avoid contact with the medial femoral condyles since they can trigger adduction contractures. The seat module is then padded on a conventional vacuum table with a one fourth inch thick preheated Volara foam layer between the bolsters and down through the full length of the seat. The edges of the Volara foam should be sanded down at the wedge roll to make a smooth edge.

If the seat module 22 is properly fitted, the back module 20 can be placed at the standard 90 degree angle to the seat module. Even if the user cannot sit in a fully upright position during this fitting period, he may now be able to do so if the seat module 22 relaxes abnormal tone. There may be a need in some cases to add a conventional chest panel, bandolier straps, or chest straps.

Thoracic support elements 138 and 140 will usually be necessary unless the user has no difficulty sitting in an upright position. Proper placement of thoracic supports 138 and 140 is critical and needs to be done with care. To fit the user, he should be centered on the back module foam surface and thoracic supports 138 and 140 placed on either side of his front. If the user has scoliosis, then the thoracic supports must be placed in a position that most supports his spinal curvature. The positions of thoracic supports 138 and 140 are marked on the surface of foam layer 136 with a marking pen. Foam 136 and the bottom surfaces of thoracic support elements 138 and 140 are sprayed at corresponding surfaces with contact cement and the corresponding surfaces adhered thereafter. Care should be taken in adhering thoracic supports 138 and 140 to insure that there is at least a half inch gap on either side of the trunk to allow for the Volara foam and vinyl covering taking up at least one fourth of an inch on each side. The tops of the thoracic supports 138 and 140 should be under the user's arms but should not interfere with movement of the arms while pushing a wheelchair, and must not otherwise restrict the general movement of the user's arms. It may, therefore, be necessary to grind away the foam at the top of the thoracid supports 138 and 140 in these regions. Naturally, informational feedback from the user to the clinician is essential in determining precisely how much and where to remove the foam.

Patients with moderate thoracic kyphosis often sit in a more upright position if a small lumbar support pad 142 is incorporated into back module 20. Again, informational feedback from the user to the clinician must decide the height at which the lumbar pad should be adhered to the surface of foam layer 136 between thoracic supports 138 and 140. Likewise, the user must advise the clinician where and how much to relieve the lumbar support for maximum benefit. It is customary to use such a lumbar support pad in conjunction with a well-padded conventional chest panel.

If the user exhibits a moderate to severe scoliosis or bony prominences, then there may be a need to use at least a one inch thick layer of Volara foam padding over the Ethafoam surface. This foam should be placed over the entire back module, keeping in mind the need to allow for a half inch margin at each side for the finish foam and vinyl cover. If additional conventional elements such as a chest panel, a headrest or neck support are to be used, these may be attached in the conventional way to fittings such as fitting 60 for the headrest, and portions of the wheelchair frame as appropriate. Likewise, if a footrest must be used, it should be adjusted to movement within slot 98 of bracket 96 and slots 57 in adjustable members 56, as best seen in FIG. 3. The height of the footrest must be adjusted so that the user's knees are parallel with the surface of the seat and are not pushed into the front edge of the seat. The clinician will be guided in his initial adjustment by length G, FIG. 4, but ultimately by informational feedback from the user.

The choice between the alternative outriggers illustrated in FIGS. 12A and 12B will be dictated by the dimensions of the wheelchair and the patient. Thus, if the patient is relatively wide, and needs correspondingly wide seat and back modules within a wheelchair that does not allow much room, outriggers of the type illustrated in FIG. 12B may be indicated.

As a final matter at the initial fitting stage, the clinician must insute that the patient is in fact supported adequately and is comfortable sitting all the way back in the seat. If the patient is to propel his own wheelchair, he should be able to wheel himself freely. The seat should be sufficiently low on the frame to allow such a patient access to the wheels. The seating system should be easily placeable and removable from the wheelchair by means of pop-in pin attachments 72 and 192. There should be sufficient space left at the bend of the knee, at the thoracic supports, and at the lateral leg support bolsters for a final foam and vinyl covering. The clinicial should also check the patient's posture and the effect thereon of moving the seating system interior or posterior to the nominal center of gravity of the wheelchair.

The clinician should also mark at the hinge the location of back module 20 and seat module 22 at the respective hinge arms.

The patient is then removed from the seating system and a one fourth inch thick Volara foam covering is applied to both the back and seat modules and each is covered with a temporary vinyl covering stapled at the edges to the respective backs of the modules. The seating system is then reassembled back to the marked positions and provided to the new user for his use for a period preferably of two weeks.

During the brief trial period the user will become adjusted to the seating system and become aware of any further modifications that need to be made to the topology of the support surfaces. After this trial period the user and the clinician should review all problems and take appropriate action. This will require a removal of the temporary covering and the quarter inch Volara foam, followed by grinding off of Ethafoam where local relief is desired and the addition of Ethafoam where additional local support is indicated. A second, permanent, coating of Volara foam is then applied to each of the seat and back modules and each is provided with a permanent vinyl covering. At this stage vinyl covering is provided to the bottom of the seat module 22 and to the rear surface of back module 20. The seating system is then fitted into the user's wheelchair. It is now customized to his particular needs and available for prolonged use.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A modular body support system custom-fitted to a particular user, comprising:

a seat module comprising a seat base and a layer of readily sculptable material attached thereto, said seat base and sculptable material being sized and shaped initially on the basis of the user's body measurements in the seat region that is to be supported, the initial topology of said sculptable material being such as to enable sculpting thereof in iterative response to the user's reaction when seated thereon by removal of sculptable material to relieve unacceptable local pressure and addition of sculptable material to enhance local support to the user, as needed, to generate a custom-fitted user-supportive seat module topology; and a back module, cooperating with said seat module, comprising a back base and a layer of said readily sculptable material attached thereto, said back base and sculptable material being sized and shaped initially on the basis of the user's body measurements in the back region that is to be supported, the initial topology of said sculptable material being such as to enable sculpting thereof in iterative response to the user's reaction when supported thereby in seated posture by removal of sculptable material to relieve unacceptable local pressure and addition of sculptable material to enhance local support to the user, as needed, to generate a custom-fitted user-supportive back module topology.

2. A modular body support system according to claim 1, wherein:

said seat module and said back module are each provided with a covering layer to protect the custom-fitted topology of said sculptable material thereof during use of the body support system.

3. A modular body support system according to claim 1, wherein:

said sculptable material comprises a firm, resilient, foamed plastics material.

4. A modular body support system according to claim 1, wherein:

said seat base and said back base are each selected from a respective plurality of seat and back bases each comprising a range of predetermined modular sizes and shapes of the respective seat and back bases.

5. A modular body support system according to claim 3, wherein:

said sculptable resilient foam layer attached to said seat base comprises a central element and a leg supporting element on either side thereof, said central element and said leg supporting elements each being selected from a respective plurality of central and leg supporting elements each comprising a range of predetermined modular sizes and shapes of the respective central and leg supporting elements, the initial topology of each of said elements being such as to enable sculpting thereof to custom-fit a user.

6. A modular body support system according to claim 5, wherein:

said central element has a base that attaches to said seat base and an upper surface inclined downwardly from the front to the rear of said seat base.

7. A modular body support system according to claim 6, wherein:

said inclination of said upper surface with respect to said seat base is approximately 15 degrees prior to sculpting thereof for said custom-fitting.

8. A modular body support system according to claim 1, wherein:

adjustable attachment means are provided to both the seat and back modules for attachment thereof to a common supporting frame.

9. A modular body support system according to claim 8, wherein:

said seat module is pivotally attached to said back module.

10. A modular body support system according to claim 9, further comprising:

an adjustable footrest attached to said seat module; and a headrest attached to said back module.

11. A modular body support system custom-fitted to a particular user, comprising:

a seat module comprising a seat base and a layer of readily sculptable material attached thereto, said seat base and sculptable material being sized and shaped initially on the basis of the user's body measurements in the seat region that is to be supported, and the topology of said sculptable material sculpted in iterative response to the user's reaction when seated thereon by removal of sculptable material to relieve unacceptable local pressure and addition of sculptable material to enhance local support to the user as needed to generate a custom-fitted user-supportive seat module topology; and a back module, cooperating with said seat module, comprising a back base and a layer of said readily sculptable material attached thereto, said back base and said sculptable material being sized and shaped initially on the basis of the user's body measurements in the back region to be supported, and the topology of said sculptable material sculpted in iterative response to the user's reaction when supported thereby in seated posture by removal of sculptable material to relieve unacceptable local pressure and addition of sculptable material to enhance local support to the user, as needed, to generate a custom-fitted user-supportive back module topology, wherein said sculptable material comprises a firm, resilient, foamed plastics material and said sculptable resilient foam layer attached to said back base comprises a flat element substantially covering one side of said back base and a thoracic support element attached thereto along each of two parallel sides of said back base, said flat element and said thoracic support elements each being selected from a respective plurality of flat and thoracic support elements each comprising a range of predetermined modular sizes and shapes of the respective flat and thoracic elements.

12. A method of custom-fitting to a particular user a body support system comprising a seat module and a cooperating back module, said seat and back modules each comprising a respective base element to which are attached a combination of user-supportive elements of readily sculptable material selectable from a respective plurality of the same preformed in a range of predetermined modular shapes and sizes, comprising the steps of:

measuring the user, preferably in an approximately correct seating posture, to determine his body measurements in the regions to be supported;

selecting on the basis of said body measurements from said pluralities of seat and back base elements a seat base element and a back base element, respectively, each being of a width and a length to comfortably accommodate said user with side room to attach thereat selected ones of said sculptable elements to provide lateral support to the user as needed;

selecting from said modular sculptable elements, on the basis of said body measurements, those elements which combine in shape and size to provide desired supportive topologies approximately matching the user's body in a seated posture at portions thereof to be supported by said seat and back modules respectively;

attaching said selected sculptable elements to said seat and back base elements, respectively, to form said approximate topologies of sculptable material;

supporting said seat and back bases such that their respective approximate topologies of sculptable material are disposed to coact to support said user;

seating said user so as to be supported by said approximate topologies of sculptable material, to determine from the user's response where and how much sculptable material must be removed to relieve unacceptable local pressure and where and how much sculptable material must be added to enhance local support to the user;

iteratively modifying said approximate topologies in accordance with the user's response, by such removal and addition of sculptable material, until custom-fitted topologies satisfactory to the user are generated on the sculptable material combinations attached to said seat and back base elements;

attaching a covering over said sculptable material to form smooth surfaces of said seat and back modules; and mounting said seat and back modules to cooperatively support the user.

13. A method according to claim 12, wherein:

the step of measuring said user includes measuring a width A at a level approximately two inches below the axilla, a width B at the widest part of the hips, a width C between the outsides of the knees held horizontally in line with the hips, a length D from the spine of the scapula to the seat, a length E from the level of measurement A to the seat, a length F from the iliac crest to the seat, a length G from the seat to the sole of the foot and a length H from the sacrum to the back of the knee; and the step of selecting said seat and back bases includes selecting a seat base element that is at least two inches wider than the larger of said widths B and C and a back base element that is at least two inches wider than said width A.

14. A method according to claim 13, wherein:

the step of supporting said seat and back bases includes the step of pivotally connecting them to each other to pivot about an axis parallel to the rear edge of the seat module and the lower edge of the back module, such that the distance from the seat surface at the rear to the top of the back module is approximately equal to said length D and the distance from the back surface horizontally to the back of the knee is approximately half an inch less than said length H.

15. A method according to claim 14, including the further step of:

attaching after said topology modifying step a thin, resilient and conforming layer of a plastics material to said custom-fitted topologies of said seat and back elements prior to attaching said cover thereover.

16. A method according to claim 14, including the further step of:

examining said body support system and said user's adaption thereto after a brief trial period of use, to determine whether further modification of the custom-fitted topologies of said seat and back modules is indicated; and where said further modification is indicated, removing said cover and thin resilient layer and iteratively finesculpting said sculptable material of said seat and back modules in accordance with the user's response to improve the customfitting of said support system;

applying a permanent thin, resilient and conforming layer to said custom-fitted topologies of said seat and back modules; and applying permanent coverings to said seat and back modules.

17. A modular body support system according to claim 2, wherein:

said covering layer comprises a thin, resilient and conforming layer of a foamed plastics material, preferably somewhat softer than said sculptable material and adhered thereon after said iterative sculpting to custom-fit the user, and a smooth, outermost, user-contactable layer adhered onto said thin layer.

* * * * *